US005518489A

United States Patent [19]

Willis et al.

[11] Patent Number: 5,518,489

[45] Date of Patent: May 21, 1996

[54] APPARATUS AND METHOD FOR FORMING A POCKETED CARD STOCK OR PAPER MEMBER HAVING A WIDE PERIPHERAL EDGE

[75] Inventors: Jerry W. Willis, Mesquite; Gregory S. Herbig, Duncanville, both of Tex.

[73] Assignee: Haskins Manufacturing Company, Mesquite, Tex.

[21] Appl. No.: 242,272

[22] Filed: May 13, 1994

[51] Int. Cl.[6] ..... B65H 45/30

[52] U.S. Cl. ..... 493/163; 493/182; 493/175; 493/394; 493/132; 493/124; 493/125; 493/126; 493/127

[58] Field of Search ..... 493/394, 438, 493/442, 443, 446, 447, 124, 125, 126, 127, 131, 132, 147, 175, 163, 182

[56] References Cited

U.S. PATENT DOCUMENTS

| | | | |
|---|---|---|---|
| 1,485,004 | 2/1924 | Wright | 493/163 |
| 3,461,642 | 8/1969 | Langen | 493/131 |
| 5,120,292 | 6/1992 | Ueda | 493/124 |
| 5,230,687 | 7/1993 | Lombardo | 493/127 |
| 5,269,744 | 12/1993 | Moll | 493/421 |

*Primary Examiner*—Jack W. Lavinder
*Attorney, Agent, or Firm*—Gregory M. Howison

[57] ABSTRACT

A device and method for forming a pocketed card stock or paper member having a wide peripheral edge. A template (12) is provided having a forming edge with a shape corresponding to the wide peripheral edge of the member. A flexible sheet of card stock or paper (14) is also provided. An urging device (62) is provided for urging the flexible sheet of card stock or paper (14) adjacent to the template (12) such that an extended portion (54) thereof extends beyond the forming edge of the template (12) and a remaining portion thereof does not extend beyond the forming edge of the template (12). A folding device (26) is provided for urging the extended portion (54) around the forming edge and a securing device (24) is provided for securing the extended portion (54) to the remaining portion of the flexible sheet of card stock or paper (14) after the extended portion (54) has been urged around the forming edge to form a wide edge. The flexible sheet of card stock or paper (14) is held into contact with the template (12) with vacuum pressure. The folding device comprises a roller (26) or a spring loaded bar (86) to force the wide edge of the flexible sheet (14) around the template (12) to form two creases in the flexible sheet (14).

14 Claims, 9 Drawing Sheets

APPARATUS AND METHOD FOR FORMING A POCKETED CARD STOCK OR PAPER MEMBER HAVING A WIDE PERIPHERAL EDGE

TECHNICAL FIELD OF THE INVENTION

The present invention pertains in general to paper and card stock folding machines, and more particularly, to folding machines forming pocketed card stock or paper members having a wide peripheral edge.

BACKGROUND OF THE INVENTION

The printing and publishing industry has long used folding machines to fold paper stock into many different configurations. Folding machines have conventionally been used to fold everything from leaflets and sheets of regular paper to card stock. Folding machines have also been used to form pocketed folders; however, these pocketed folders had substantially no width to their pockets. The pocket was formed by a single fold. These general purpose paper folding machines typically employed a first roller assembly which included many folding rollers which operated in conjunction with fold pans supported on a parallel fold pan rail at differing levels adjacent to the folding rollers. Paper or card stock passed through a set of rollers would travel through the roller pair and engage the fold pan, whereupon the stock buckled and returned through a folding roller pair.

The prior art flat pocketed folders could be used to hold a few sheets of paper, but could not be used to hold a large number of papers or anything thicker than a few pieces of paper. To form a pocketed folder with a wide edge, using two folds, such that a large number of papers or something larger than a few pieces of paper could be put in the folder, the folders had to be formed by hand. These wide edged, pocketed card stock or paper folders could range through any size and could even take the form of a small box. The main problem was that manufacturing was time consuming since it was done by hand.

SUMMARY OF THE INVENTION

The present invention disclosed and claimed herein comprises a device and method for forming a pocketed card stock or paper member having a wide peripheral edge. A template is provided having a forming edge with a shape corresponding to the wide peripheral edge of the member. A flexible sheet of card stock or paper is also provided. An urging device is provided for urging the flexible sheet of card stock or paper adjacent to the template such that an extended portion thereof extends beyond the forming edge of the template and a remaining portion thereof does not extend beyond the forming edge of the template. A folding device is provided for urging the extended portion around the forming edge and a securing device is provided for securing the extended portion to the remaining portion of the flexible sheet of card stock or paper after the extended portion has been urged around the forming edge to form a wide edge. The flexible sheet of card stock or paper is held in contact with the template with vacuum pressure. The folding device comprises a roller or a spring loaded bar to force the wide edge of the flexible sheet around the template to form two creases in the flexible sheet.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
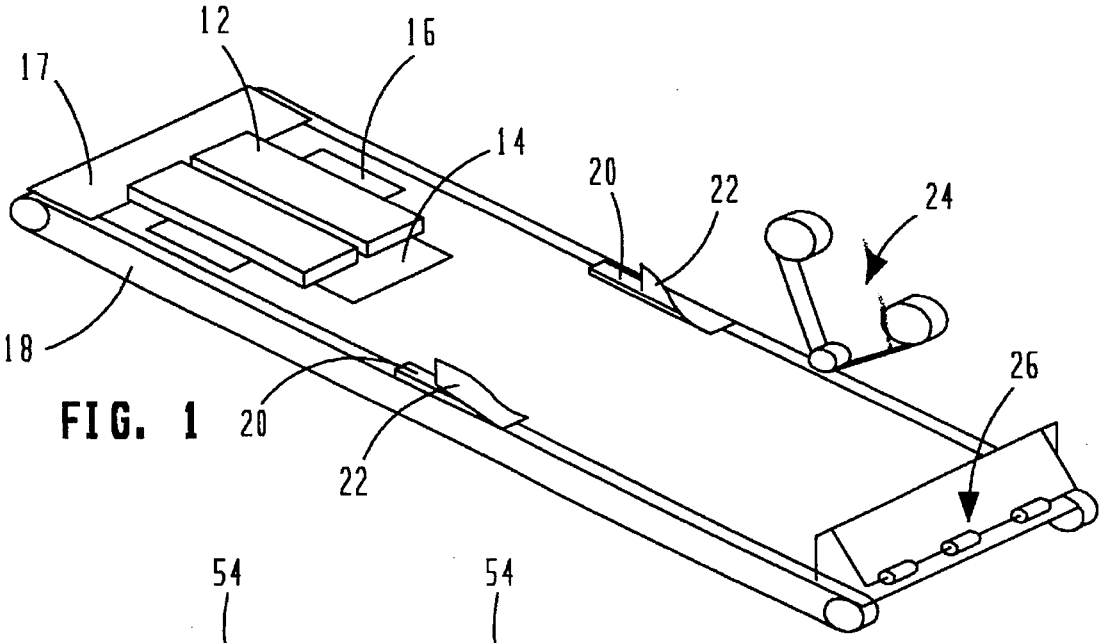
FIG. 1 illustrates a perspective view of the system of the present invention.

Referring now to FIG. 1, there is illustrated a perspective view of the system of the present invention. A two-piece template 12 is provided. A piece of card stock or paper 14 with an extended portion is provided and is placed into contact with the template. The piece of card stock or paper 14 has tabs 16 extending from its side. The template is attached to a carriage 17 which is driven by a chain or a belt drive 18 to move the template 12 down the device. Two ramps 20 are provided to fold the tabs at a 90° angle such that they are perpendicular to the piece of card stock or paper 14. Two plows 22 are provided to fold the tabs 16 around the template 12 at another 90° angle such that they are parallel to the piece of card stock or paper 14. An adhesive mechanism 24 is provided to place adhesive on the folded tabs 16. Even though adhesive refers to tape in the preferred embodiment, it should be noted that adhesive includes glue, as well as tape. A folding roller 26 is provided to crease the extended portion of the card stock or paper 14 around the template 12 such that a wide edge is formed. The folding roller 26 also presses the extended portion of the paper or card stock 14 into contact with the tabs 16, which have been folded and have had adhesive applied to them.

Figure 1A:
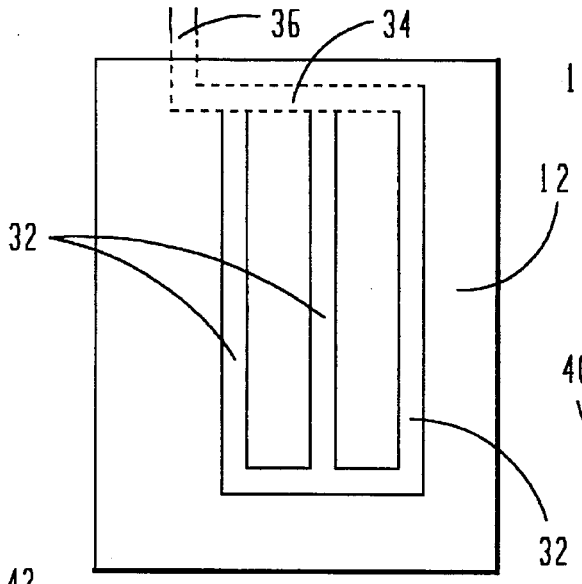
FIG. 1*a* illustrates a bottom view of one section of the template.

Referring now to FIG. 1*a*, there is illustrated a view of the underside of one section of the template 12. Channels 32 are provided on the underside of the template 12. The channels 32 are connected by an enclosed inner chamber 34 to a hose 36 which is connected to a vacuum pressure.

Figure 1B:
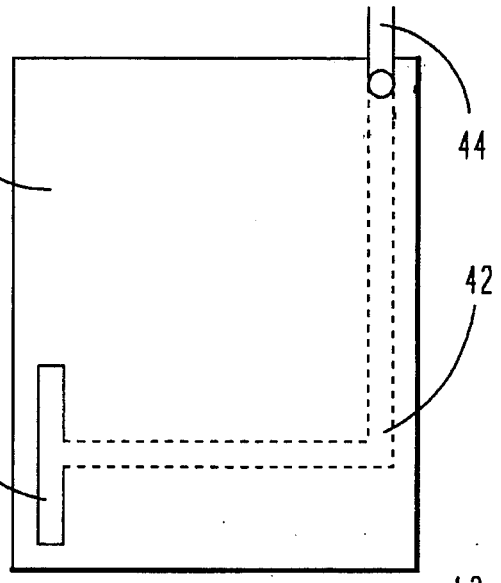
FIG. 1*b* illustrates a top view of one section of the template.

Referring now to FIG. 1*b*, there is illustrated a view of the top side of one portion of the template 12. A channel 40 is provided in the corner of the template corresponding to the position of the folded card stock or paper tab 16. The channel 40 is connected by an enclosed inner chamber 42 to a vacuum hose 44.

Figure 1C:
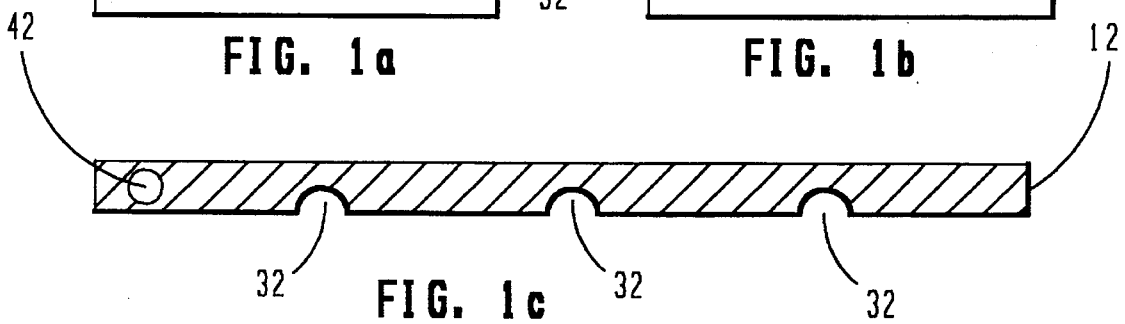
FIG. 1*c* illustrates a cross-sectional view of one section of the template.

Referring now to FIG. 1*c*, there is illustrated a cross-sectional view of one portion of the template 12. The bottom channels 32 are shown, as is one of the enclosed inner chambers 42.

Figure 1D:
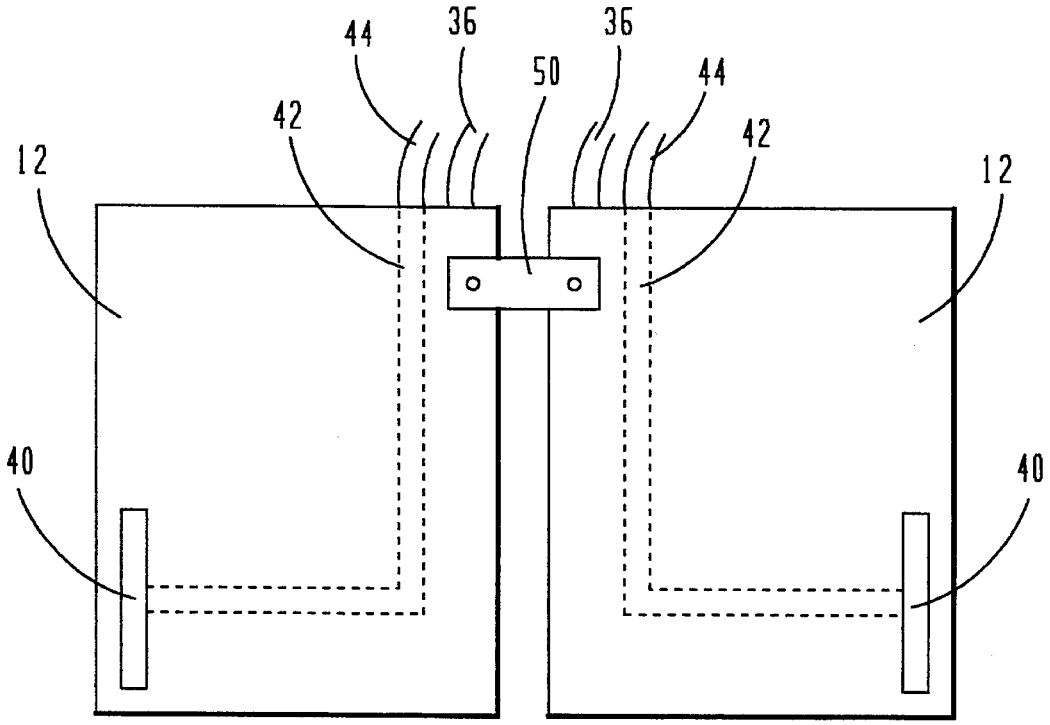
FIG. 1*d* illustrates a top view of both sections of the template.

Referring now to FIG. 1*d*, there is illustrated a top view of a full template 12 with the two portions connected together. There is shown a connecting bracket 50 and the two inner chambers 42, as well as the top channels 40. The vacuum hoses 36 and 44 are also shown.

Figure 2A:
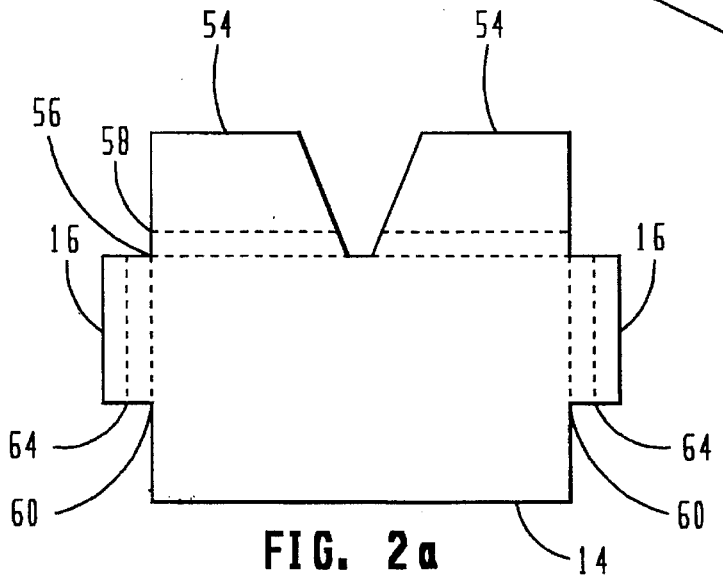
FIG. 2*a* represents a top view of the flexible sheet of card stock or paper.

Referring now to FIG. 2*a*, there is illustrated a top view of an example of a flexible sheet of card stock or paper 14 used in the present invention. The flexible sheet of card stock or paper 14 has two extended portions 54, which extend beyond a first fold score 56 and a second fold score 58. The flexible sheet of card stock or paper 14 also has two card stock or paper tabs 16 extending therefrom. These card stock or paper tabs 16 contain a first fold score 60 and a second fold score 64.

Figure 2B:
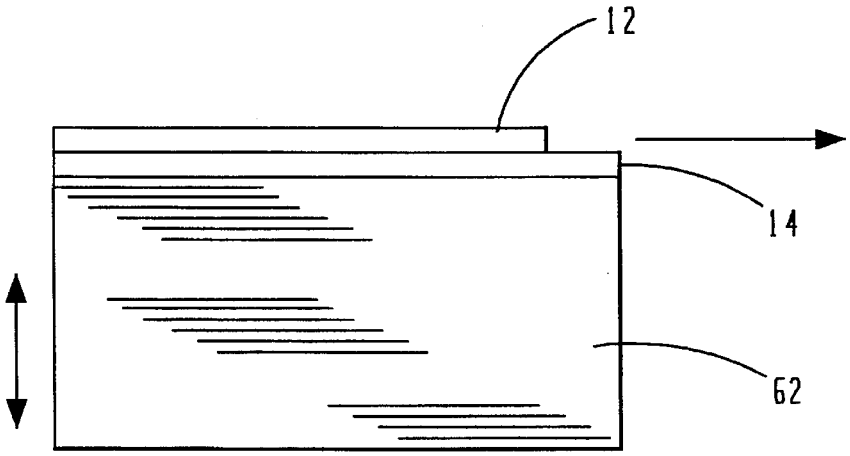
FIG. 2*b* represents a side elevational view of the card stock or paper supply bin in the template.

Referring now to FIG. 2*b*, there is illustrated a side elevational view of a card stock or paper supply bin 62, the flexible sheet of card stock or paper 14 and the template 12. The supply bin 62 contains numerous sheets of flexible sheets of card stock or paper 14. The supply bin 62 containing the flexible sheets of card stock or paper 14 is placed directly beneath the template 12.

In operation, the supply bin 62 moves upward until the template 12 is in contact with the uppermost flexible sheet of card stock or paper 14. At this time, a vacuum pressure source (not shown) is turned on and connected to the vacuum hose 36 and air is vacuumed out of the inner chamber 34 and the channels 32 such that the flexible sheet of card stock or paper 14 remains attached to the template 12. The edges of the template 12 correspond to the first fold scores 60 and the first fold score 56 of the extended portion 54 of the flexible sheet of card stock or paper 14. After the sheet of card stock or paper 14 is attached to the template 12, the supply bin 62 lowers such that it is out of the way of the carriage 17. The carriage 17, which supports the template 12, is then moved by the chain or belt drive 18.

Figure 3:
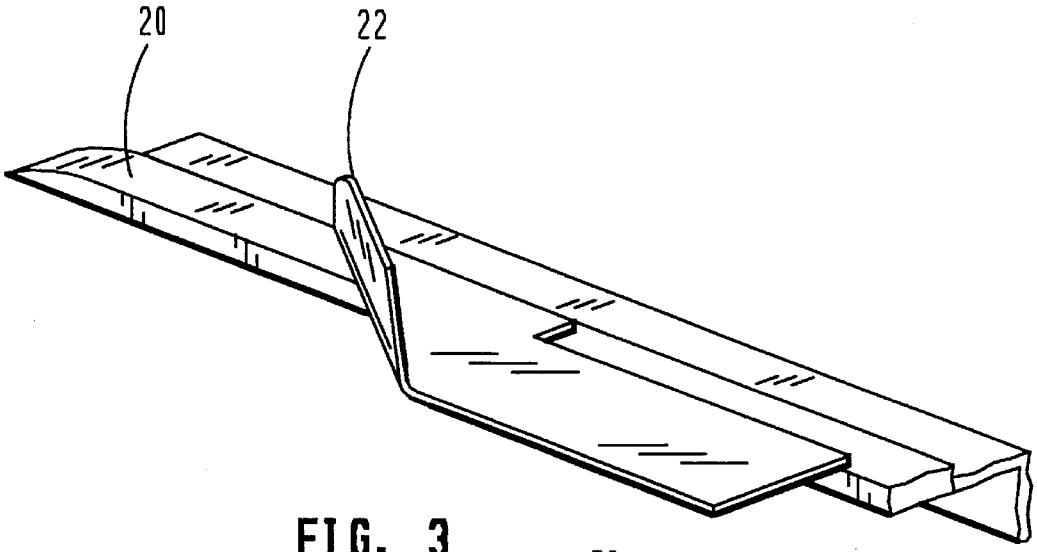
FIG. 3 represents a perspective view of the ramp and the folding plow.

Referring now to FIG. 3, there is illustrated a perspective view of the ramp 20 and plow 22. The ramp 20 extends beyond the plow 22 and the plow 22 extends across the top portion of the ramp 20.

Figure 3A:
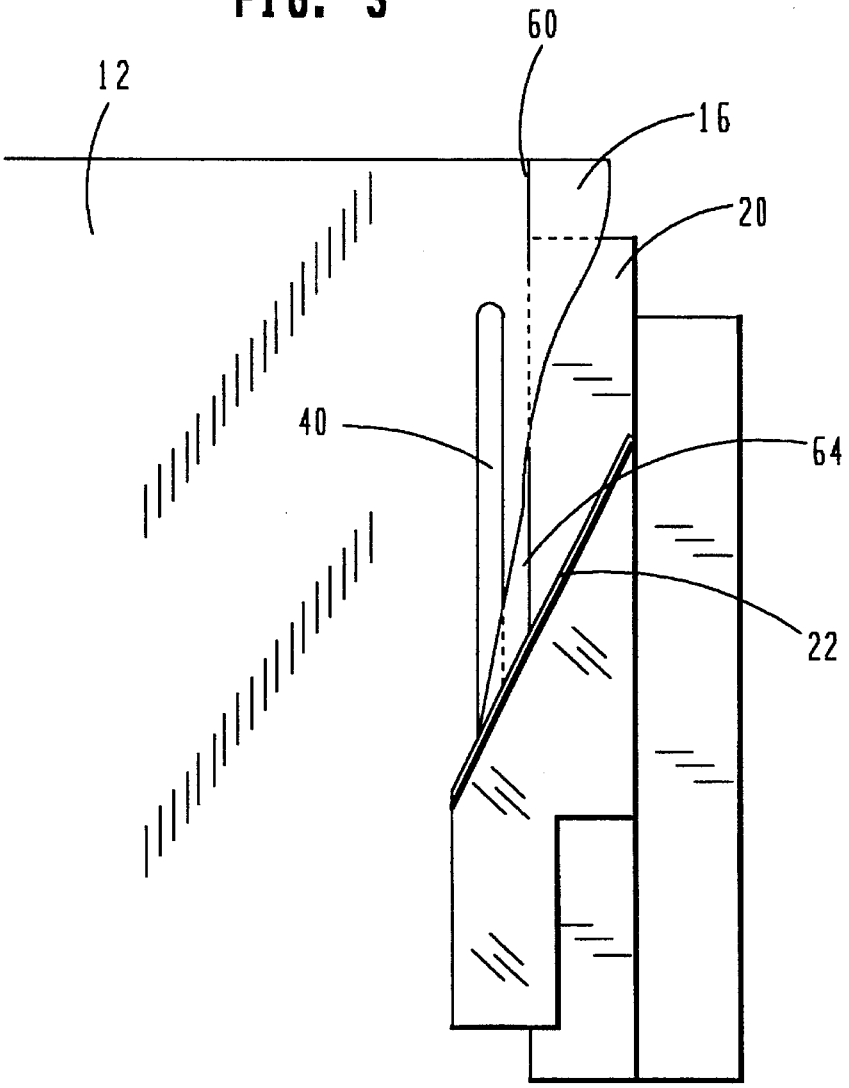
FIG. 3*a* represents a top view of the ramp and the folding plow.

Referring now to FIG. 3*a*, there is illustrated a top view of the ramp 20 and the folding plow 22 in operation. The flexible sheet of card stock or paper 14, having card stock or paper tabs 16, is propelled by the template 12 into contact with the ramp 20. When this occurs, the card stock or paper tab 16 is lifted up and folded at a 90° angle along its first fold score 60. Then, as the tab 16 continues past the ramp, it comes in contact with the plow 22 which folds the tab 16 again at a 90° angle along its second fold score 64 onto the top of the template 12. When this occurs, negative air pressure is applied to vacuum hose 44 and inner chamber 42 such that there is a vacuum in the channel 40. This holds the folded tab 16 in place.

Figure 4:
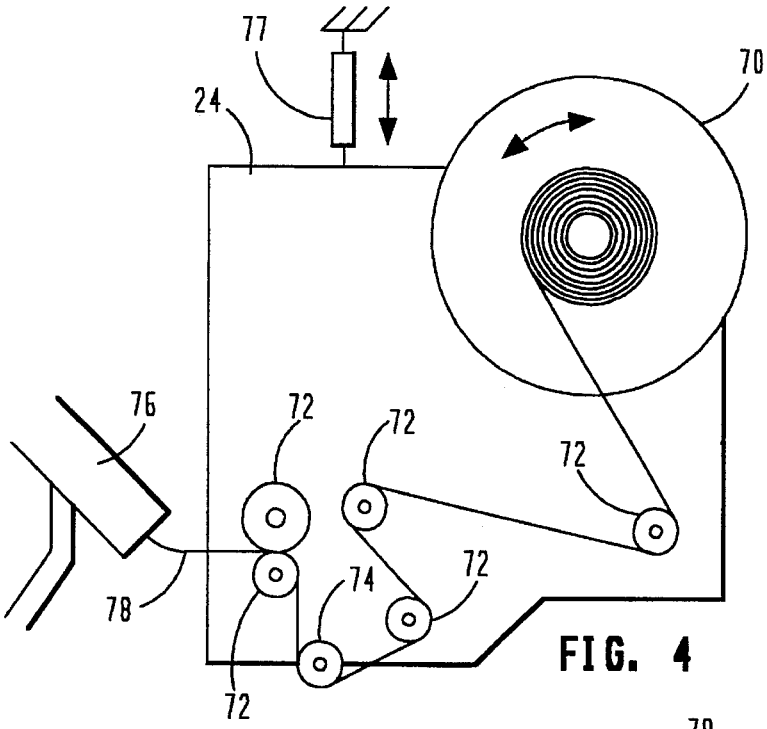
FIG. 4 illustrates a side elevational view of the tape application mechanism.
Figure 5A:
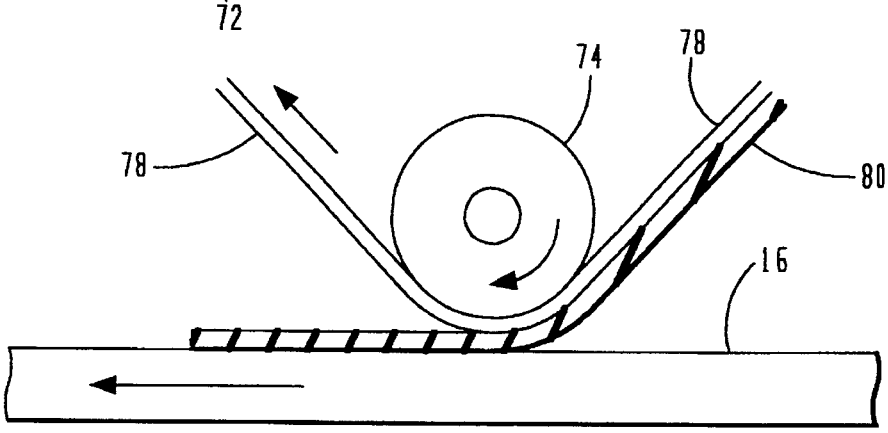
FIG. 5*a* illustrates a side elevational view of the tape application operation.
Figure 5B:
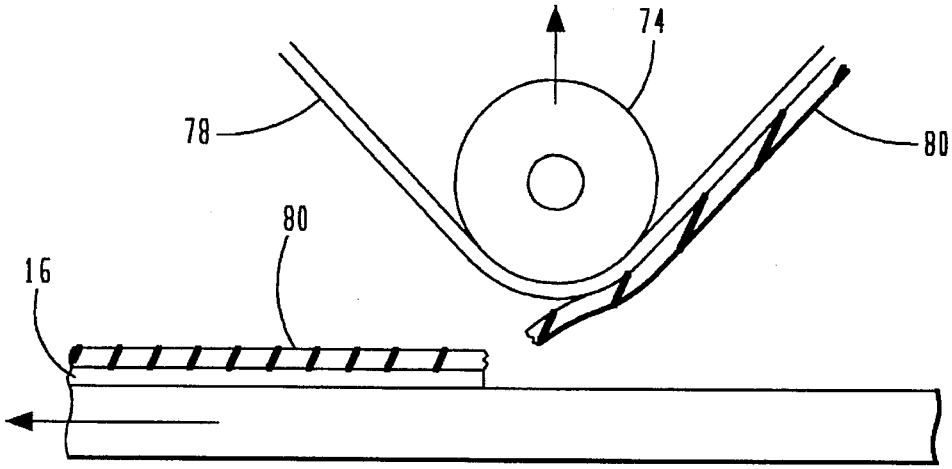
FIG. 5*b* illustrates a side view of the tape application operation after the breaking of the tape.

Referring now to FIG. 4, there is illustrated a side elevational view of the adhesive application mechanism 24. A roll of tape 70 that has adhesive 80 on both sides of the tape is provided. Idler rollers 72 are also provided. A depression roller 74 is provided for coming into contact with the tabs. A venturi 76 is provided to take up the backing from the spent tape. In operation, when the card stock or paper tab 16 is directly beneath the depression roller 74, the adhesive mechanism 24 via a pneumatic piston member 77 is lowered such that the depression roller 74 is in contact with the card stock or paper tab 16, as shown in FIG. 5*a*. As the tab 16 moves past the depression roller 74, it pulls the tape adhesive 80 along with it. After coming into contact with the card stock or paper tab 16, the tape backing 78 is pulled away from the tape adhesive 80 and the tape adhesive 80 is left attached to the card stock or paper tab 16 due to the fact that the tape adhesive 80 adheres better to the card stock or paper than to the tape backing 78. The remaining tape backing 78, after passing through two idler rollers 72, is extracted by a venturi 76. Once the end of the card stock or paper tab 16 is directly under the depression roller 74, the roll of tape 70 is stopped from turning and the whole adhesive application mechanism 24 moves upward, thereby breaking the adhesive of the tape 80, as shown in FIG. 5*b*.

Figure 6:
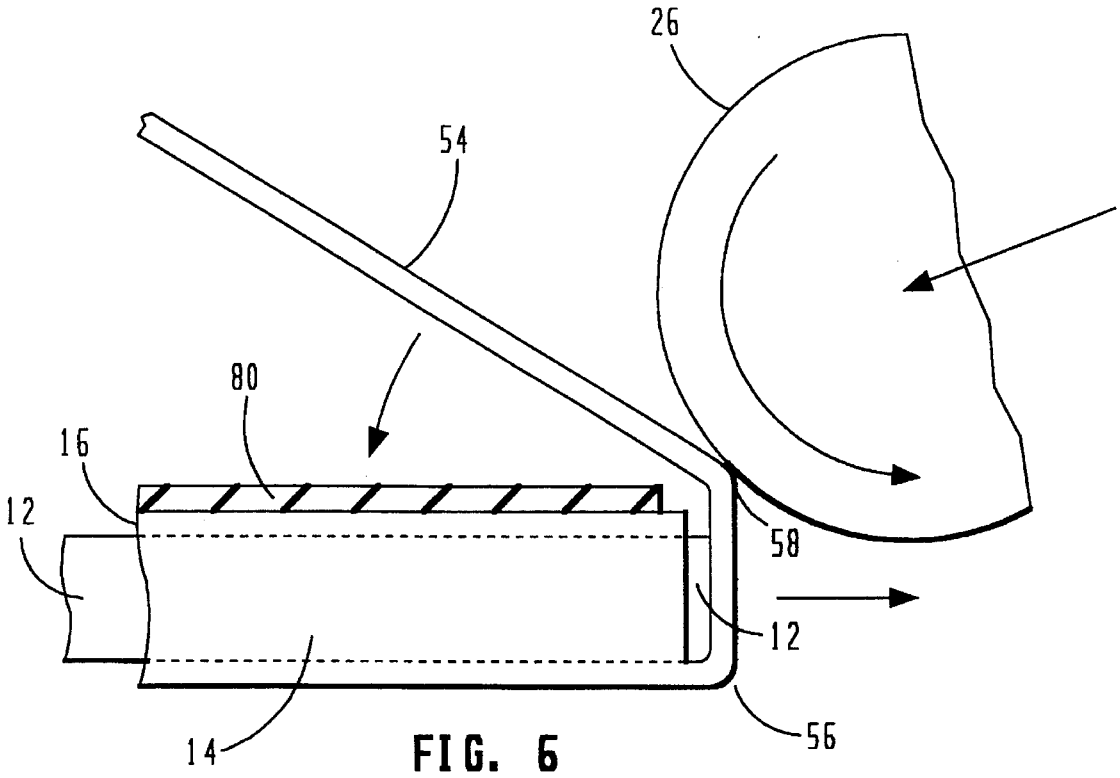
FIG. 6 illustrates a side view of the roller after folding the first crease of the wide edge and while folding the second crease of the wide edge.

Referring now to FIG. 6, there is illustrated a side view of the folding roller 26 folding the extended portions 54 of the sheet of card stock or paper 14. A blast of air pushes the extended portion 54 above the plane of the roller 26. A template 12 carries the card stock or paper sheet 14 into contact with the folding roller 26. The roller 26 makes a first fold along the first fold score 56 and then a second fold along the second score 58. These folds are made up against the template 12. After the two folds are completed, the roller 26 continues along the extended portion 54 and presses the extended portion 54 against the tape adhesive 80, which has been deposited along the tab 16.

Figure 7A:
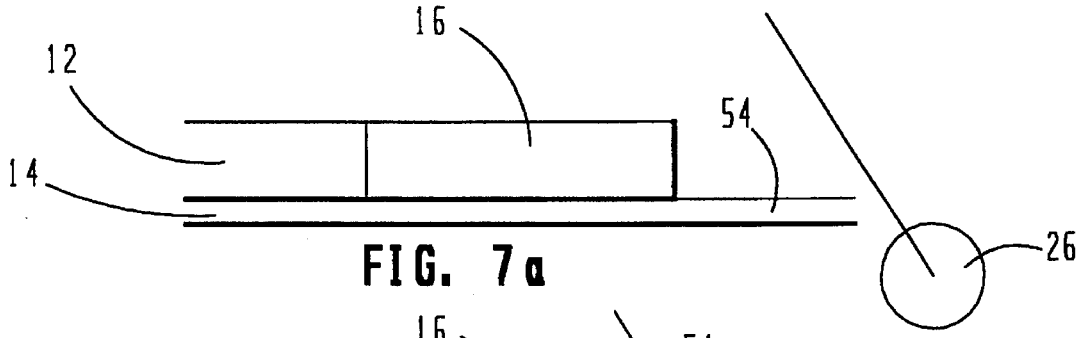
FIGS. 7*a*–7*e* illustrate side elevational views of the sequence of folding the wide edge with a roller.
Figure 7B:
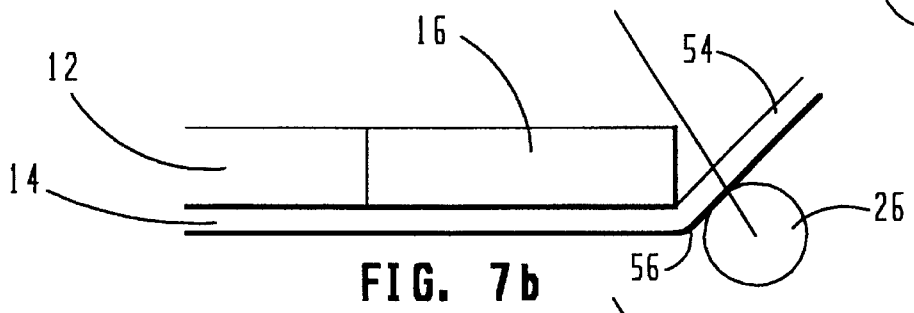
Figure 7C:
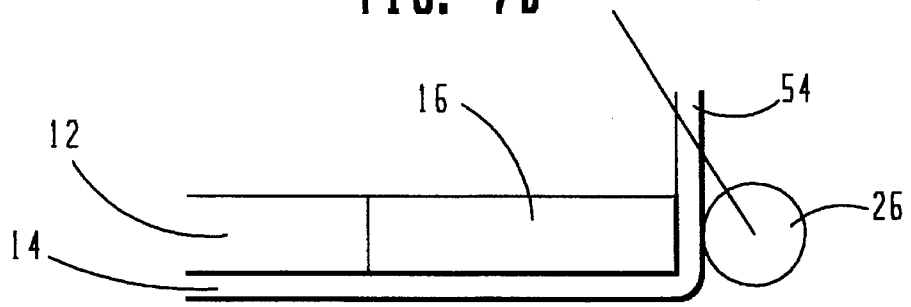
Figure 7D:
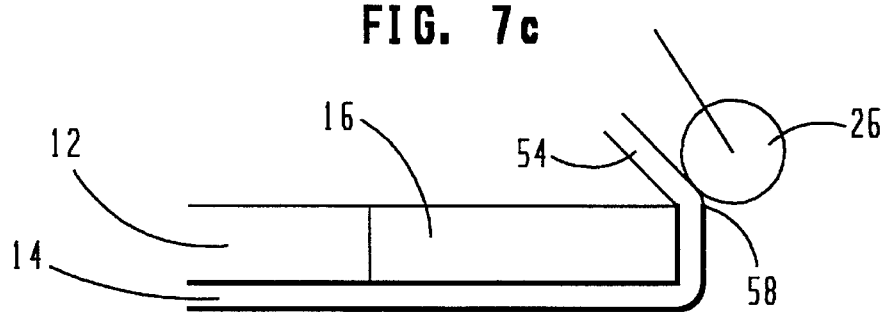
Figure 7E:
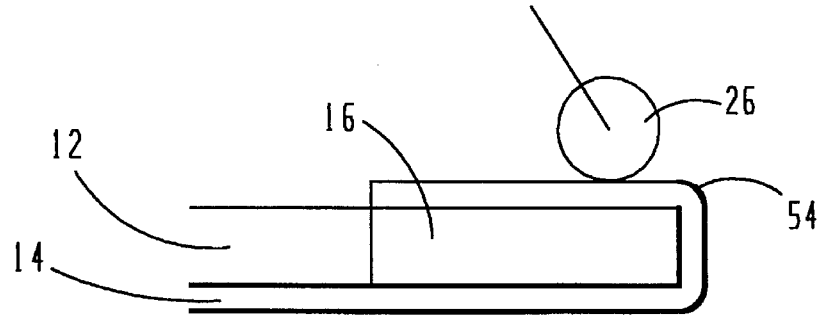

Referring now to FIGS. 7*a*–7*e*, there are illustrated sequential views of the operation of the folding roller 26. As the template 12 moves itself and the flexible sheet of card stock or paper 14 toward the folding roller 26, in FIG. 7*a*, the folding roller 26 is placed below the plane of the flexible sheet of card stock or paper 14 in the extended portion 54. When the folding roller 26 comes into contact with the extended portion 54, it begins to make the first fold along a first fold score 56, as in FIG. 7*b*. In FIG. 7*c*, the first fold has been completed and as the template 12 moves forward, the folding roller 26 moves upward and in FIG. 7*d* begins to make the second fold along the second fold score 58. After completing the second fold in FIG. 7*e*, the folding roller 26 moves along the extended portion 54 and presses it against the folded tab 16 and the two are then adhered together.

Figure 8:
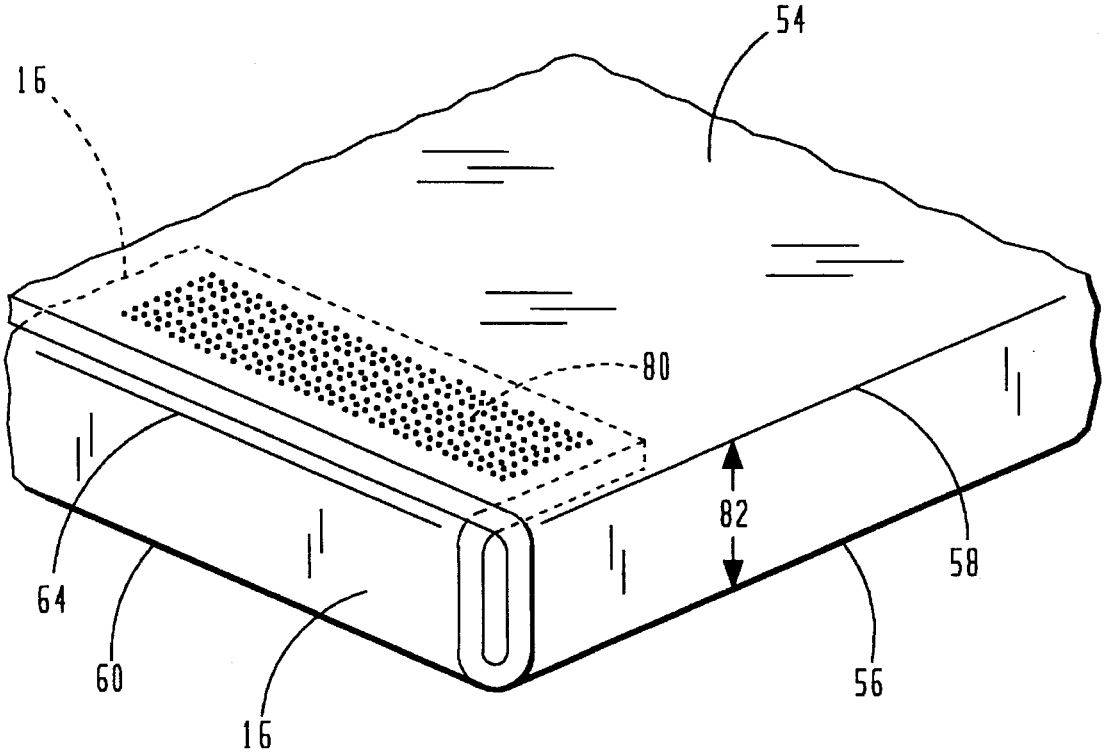
FIG. 8 illustrates a perspective view of the finished pocketed card stock or paper member.

Referring now to FIG. 8, there is illustrated a perspective view of a completed pocketed card stock or paper member 14. The extended portion 54 is shown after being folded along the first fold score 56 and the second fold score 58. The extended tab 16 is shown after being folded first on its first fold score 60 and again on its second fold score 64. The extended portion 54 has been secured to the folded portion of the extended tab 16 by tape adhesive 80. The pocket has a width 82.

Figure 9A:
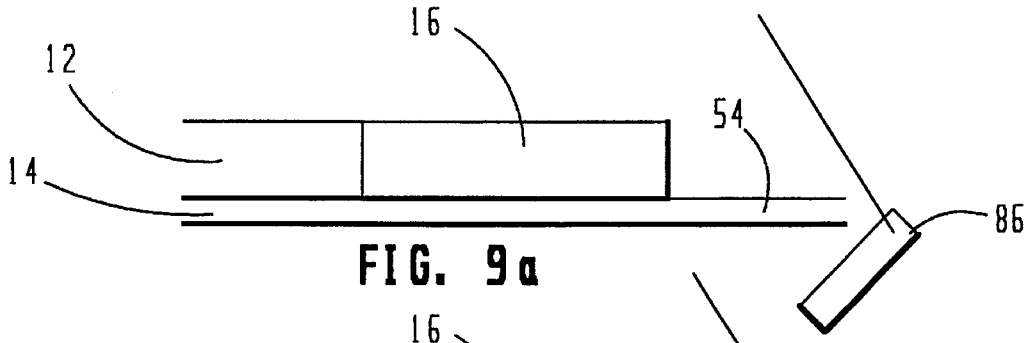
FIGS. 9*a*–9*e* illustrates a side view of the sequence of folding the wide edge with a tensioned bar.
Figure 9B:
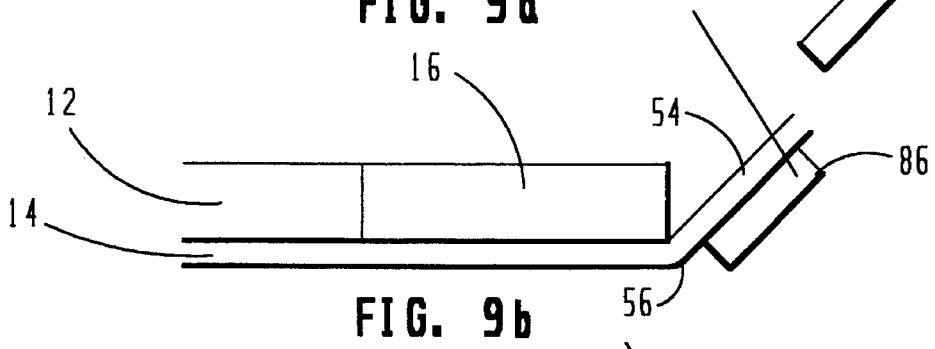
Figure 9C:
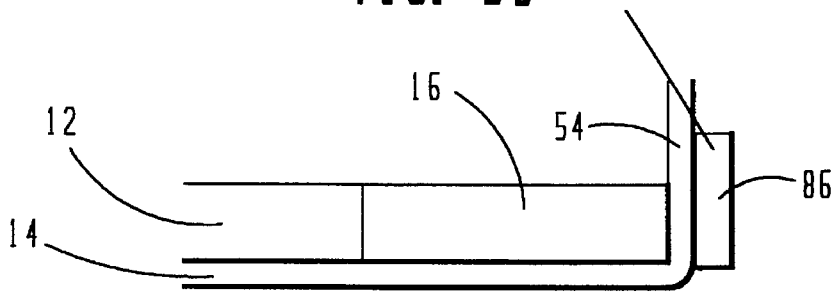
Figure 9D:
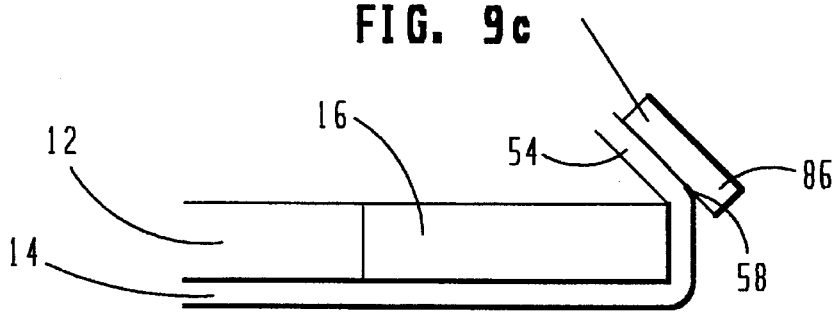
Figure 9E:
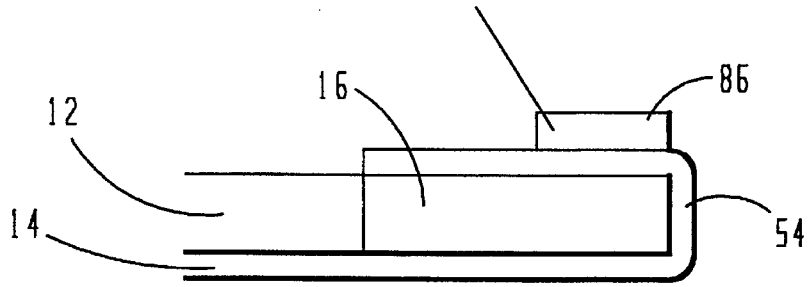

Referring now to FIGS. 9*a*–9*e*, there is shown a side view of an alternate folding operation utilizing a tension bar 86. In FIG. 9*a*, there is shown the tension bar 86, the extended portion 54 of the sheet of card stock or paper 14, the folded tab 16, the template 12 and the flexible sheet of card stock or paper 14. As the template 12 moves itself and the flexible sheet of card stock or paper 14 toward the tension bar 86, in FIG. 9*a*, the tension bar 86 is placed below the plane of the flexible sheet of card stock or paper 14 in the extended portion 54. When the tension bar 86 comes into contact with the extended portion 54, it begins to make the first fold along a first fold score 56, as in FIG. 9*b*. In FIG. 9*c*, the first fold has been completed and, as the template 12 moves forward, the tension bar 86 moves upward and, as illustrated in FIG. 9*d*, begins to make the second fold along the second fold score 58. After completing the second fold, as illustrated in FIG. 9*e*, the tension bar 86 moves along the extended portion 54 and presses it against the folded tab 16 and the two are then adhered together.

Figure 10:
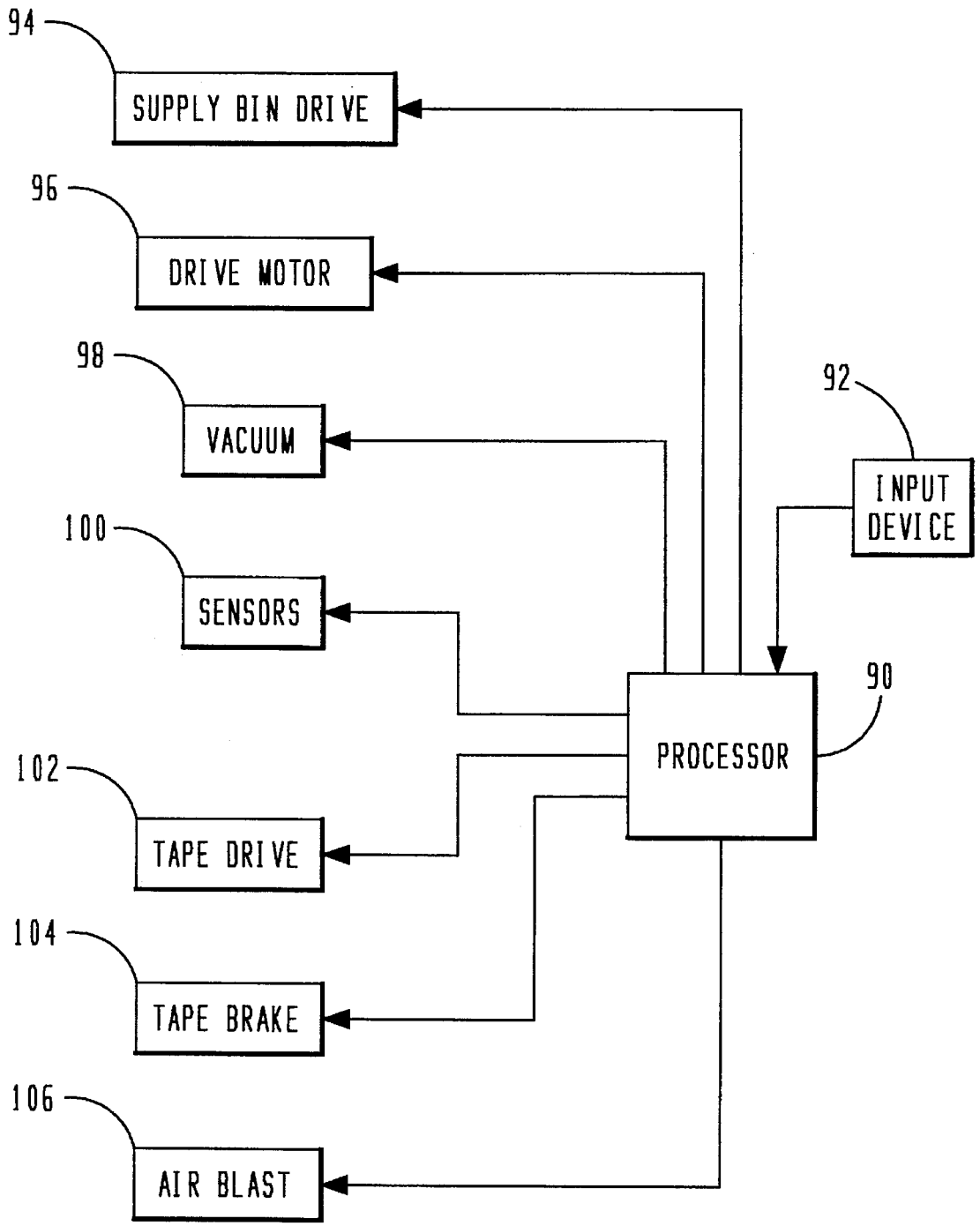
FIG. 10 illustrates a schematic representation of the control system of the present invention.

Referring now to FIG. 10, there is illustrated a schematic diagram of the control system of the present invention. A processor 90 is provided with an input device 92 interfaced thereto. Also connected to the processor 90 is a supply bin drive 94, a motor 96 for the chain or belt drive 18, a vacuum source 98 to provide vacuum, various sensors 100, the driver for the adhesive mechanism 102, a brake for the adhesive mechanism 104 and a valve 106 to release a blast of air from a pressurized air source (not shown).

Figure 11:
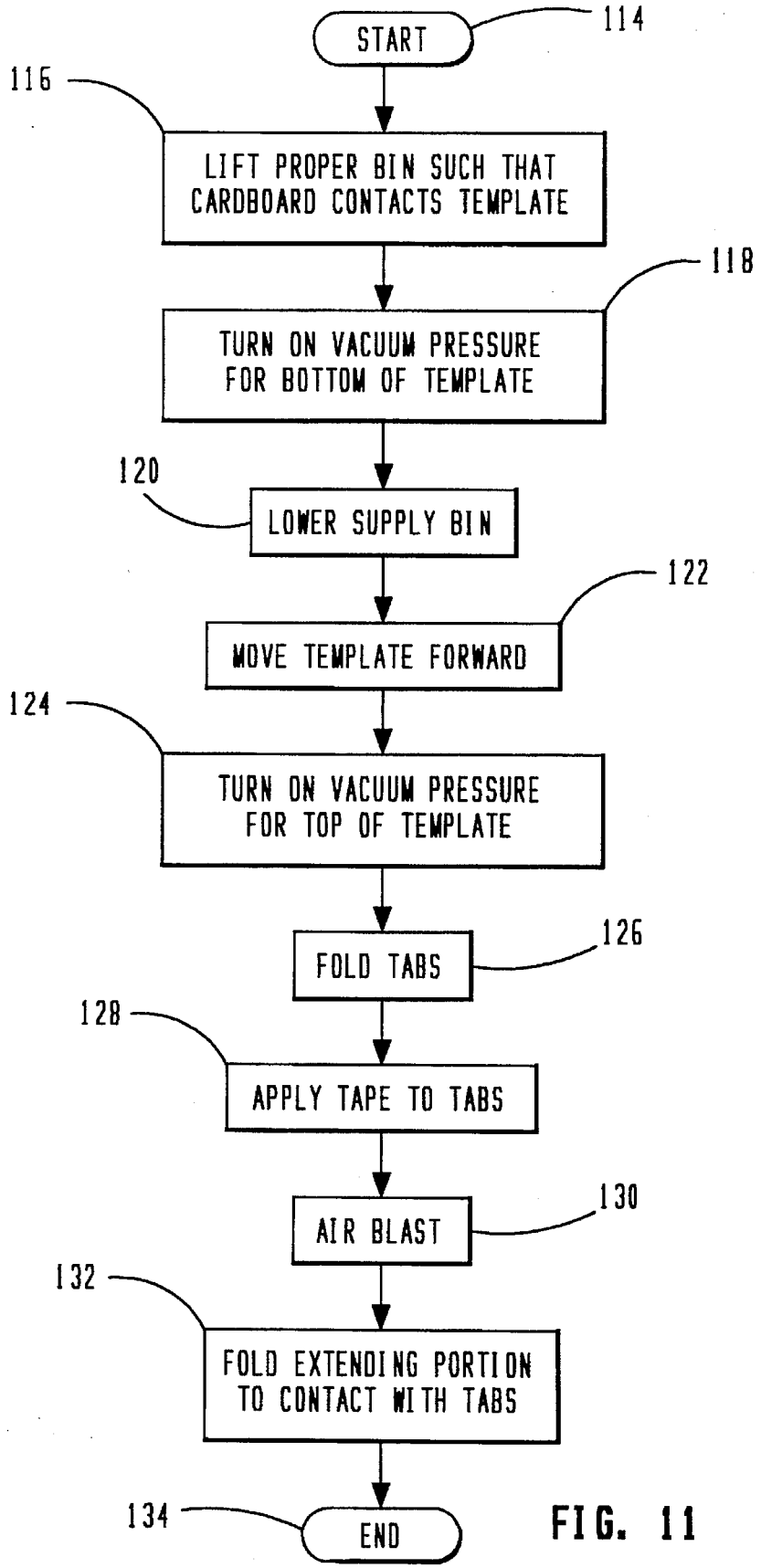
FIG. 11 illustrates a flowchart of the system of the present invention.

Referring now to FIG. 11, there is illustrated a flowchart of the operation of the present invention. After a start command is received from the input device 92, the processor 90 causes the supply bin drive 94 to lift the paper bin 62 such that the card stock or paper 14 contacts the template, as indicated in an operation block 116. After this happens, a sensor input 100 instructs the processor 90 to turn on the vacuum source 98 to the bottom of the template 12, as indicated by an operation block 118. After the vacuum source 98 has been turned on, the processor 90 instructs the supply bin drive 94 to lower the supply bin 62, as indicated by an operation block 120. Next, the processor 90 instructs the drive motor 96 to move the template 12 forward, as indicated by an operation block 122. As this happens, the processor 90 turns on a second vacuum 98 to cause vacuum pressure to be created for the top channels of the template 40, as in block 124. As this happens, the drive motor 94 continues to move the template 12 forward such that the tabs 16 come into contact with the ramp 20 and the folding plow 22 and are folded onto the top of the template 12 and held in place by the vacuum pressure, as indicated by an operation block 126. When the tabs 16 are located directly under the depression roller 74 of the adhesive application mechanism 24, sensors 100 instruct the processor 90 to control the adhesive drive 102 to lower the adhesive application mechanism 24 and, when the sensors 100 indicate that the end of the tabs 16 are moving out from under the depression roller 74, the processor 90 instructs the tape brake 104 to stop the roll of tape 70, as indicated by the operation block 128. Then, as the sensors 100 sense that the extended portion 54 is nearing the folding roller 26, the processor 90 causes an air blast 106 to push the extended portion 54 upward, as indicated in operation block 130. Next, as the extended portion 54 is moved into contact with the folding roller 26, the extended portion 54 is folded over the template 12 into contact with the tabs 16, as indicated in operation block 132. After the extended portion 54 is folded over into contact with the tabs 16, the program proceeds to an end block 134.

Although the preferred embodiment has been described in detail, it should be understood that various changes, substitutions and alterations can be made therein without departing from the spirit and scope of the invention as defined by the appended claims.

What is claimed is:

1. A method for forming a pocketed card stock member having a wide peripheral edge, comprising the steps of:

providing a template having at least two opposing surfaces and a forming edge disposed therebetween with a shape corresponding to the wide peripheral edge of the member;

providing a flexible sheet of card stock having a shape that provides extended portions and tabs that extend beyond the forming edge of the template when the flexible sheet of card stock is disposed adjacent to one surface of the template;

urging the flexible sheet of card stock adjacent to the one surface of the template such that the extended portions and tabs thereof extend beyond the forming edge of the template by disposing the flexible sheet of card stock in a supply bin and moving the one surface of the term plate into contact with the flexible sheet of card stock and adhering the flexible sheet of card stock to the one surface of the template;

urging the extended portions and tabs around the forming edge of the template and adjacent to the other of the two surfaces of the template;

securing the distal edges of the extended portions and tabs together after the step of urging the extended portions and tabs around the forming edge such that a pocket is formed; and removing the flexible sheet of card stock from the template as the pocketed card stock member.

2. The method of claim 1 wherein the step of adhering the flexible sheet of card stock to the one surface of the template comprises applying vacuum pressure through the one surface of the template to the surface of the card stock member.

3. The method of claim 1 wherein the step of urging the extended portions around the forming edge comprises using a roller to force the extended portions of the flexible sheet of card stock around the forming edge of the template.

4. The method of claim 1 wherein the step of urging the extended portions around the forming edge of the template comprises the step of urging a tension bar against the most distal portion of the extended portions and directed from the one surface of the template to the other surface of the template to force the extended portions of the flexible sheet of card stock around the forming edge of the template.

5. The method of claim 1 wherein the step of urging the extended portions around the forming edge of the template further comprises moving the template and the flexible sheet of card stock against a roller, such that the extended portions contact the roller and are urged by the roller around the forming edge of the template with the roller moving around the forming edge of the template as the template moves past the roller.

6. The method of claim 1 wherein the step of securing the distal ends of the extended portions together comprises the step of taping the distal ends of the extended portions together on the other of the two surfaces of the template.

7. The method of claim 1 wherein the step of urging the tabs of the flexible sheet of card stock around the forming edge of the template comprises the steps of:

moving the template with the flexible sheet of card stock attached thereto past a first folding member to urge the tabs upward away from the one surface and substantially adjacent the forming edge to form a first crease proximate to the juncture of the one surface and the forming edge;

moving the template with the flexible sheet of card stock attached thereto past a second folding member to urge the tabs inward toward the other surface and substantially adjacent the forming edge to form a second crease proximate to the juncture of the other surface and the forming edge.

8. A device for forming a pocketed card stock member having a wide peripheral edge, comprising:

a template having first and second opposing surfaces and a forming edge disposed therebetween, said forming edge having a shape corresponding to said wide peripheral edge of said member;

a flexible sheet of card stock having extended portions and tabs that will extend beyond the peripheral edges of said template when said flexible sheet is disposed adjacent to said first surface;

an urging device for urging said flexible sheet of card stock adjacent to said first surface of said template such that said extended portions and tabs extend beyond said forming edge of said template and the remaining portion of said flexible sheet does not extend beyond said forming edge of said template;

said urging device comprising a supply bin containing said flexible sheet of card stock and a motive device for moving said supply bin such that said supply bin may be moved to place said flexible sheet of card stock into contact with said first surface of said template and further comprising an adhering device to adhere said flexible sheet of card stock against said first surface of said template;

a first folding device for urging said extended portions around said forming edge and proximate to said second surface;

a second folding device for urging said tabs around said forming edge and proximate to said second surface; and a securing device for securing the distal ends of said extended portions to said tabs after said extended portions and said tabs have been urged around said forming edge to form a pocket.

9. The device of claim 8 wherein said adhering device comprises a vacuum device for forming a vacuum proximate to said first surface when said first surface is disposed proximate to the surface of flexible sheet of card stock.

10. The device of claim 8 wherein said folding device comprises a roller to force said extended portions of said flexible sheet around said forming edge of said template and form first and second creases in said flexible sheet proximate to the juncture between said first and second surfaces, respectively, and said forming edge.

11. The device of claim 8 wherein said folding device comprises a tension bar to force said extended portions of said flexible sheet around said forming edge of said template and form first and second creases in said flexible sheet proximate to the juncture between said first and second surfaces, respectively, and said forming edge.

12. The device of claim 8 wherein said device for securing the distal ends of said extended portions comprises an adhesive application device for dispensing a layer of adhesive between the distal ends of said extended and tabs portions that contact each other on said second surface of said template.

13. The device of claim 8 wherein said second folding device comprises:

at least one ramp operable to move past said forming edge of said template and urge said tabs upward toward said forming edge to create a first fold about a first crease proximate the juncture between said first surface and said forming edge; and at least one plow operable to move past said forming edge of said template and urge said tabs downward toward said second surface from a position substantially parallel to said forming edge to create a second fold about a second crease proximate the juncture between said second surface and said forming edge.

14. The device of claim 13 wherein said plow and said ramp are fixed and further comprising a motive device for moving said template and said flexible sheet of card stock past said plow and ramp.

* * * * *

UNITED STATES PATENT AND TRADEMARK OFFICE

CERTIFICATE OF CORRECTION

PATENT NO. : 5,518,489

DATED : May 21, 1996

INVENTOR(S) : Willis, et al.

It is certified that error appears in the above-indentified patent and that said Letters Patent is hereby corrected as shown below:

In the Claims:

Claim 1, Column 6, lines 5 and 6, replace "term plate" with --template--.

Signed and Sealed this

Twelfth Day of November, 1996

Bruce Lehman

*Attest:*

BRUCE LEHMAN

*Attesting Officer*

*Commissioner of Patents and Trademarks*